US007211960B2

(12) United States Patent
Chen

(10) Patent No.: US 7,211,960 B2
(45) Date of Patent: May 1, 2007

(54) BURGLAR-PROOF WIRELESS LIGHT ADJUSTING MODULE

(75) Inventor: Wen-Lin Chen, Taipei County (TW)

(73) Assignee: Arc Technology Co., Ltd., Taipei County (TW)

( * ) Notice: Subject to any disclaimer, the term of this patent is extended or adjusted under 35 U.S.C. 154(b) by 105 days.

(21) Appl. No.: 11/088,903

(22) Filed: Mar. 25, 2005

(65) Prior Publication Data

US 2006/0214595 A1 Sep. 28, 2006

(51) Int. Cl.
*H05B 37/02* (2006.01)

(52) U.S. Cl. ..... 315/157; 315/158; 315/159

(58) Field of Classification Search ..... 315/149–159, 315/291, 307, 56–59, 34
See application file for complete search history.

(56) References Cited

U.S. PATENT DOCUMENTS 5,489,891 A * 2/1996 Diong et al. ..... 340/567
6,114,812 A * 9/2000 Lee ..... 315/158
6,198,408 B1 * 3/2001 Cohen ..... 340/825.69
6,441,557 B1 * 8/2002 Asakura ..... 315/149
6,700,334 B2 * 3/2004 Weng ..... 315/294
6,737,803 B2 * 5/2004 Slot et al. ..... 313/580

* cited by examiner

*Primary Examiner*—Hoang V. Nguyen
*Assistant Examiner*—Dieu Hien Duong
(74) *Attorney, Agent, or Firm*—Troxell Law Office PLLC

(57) ABSTRACT

A burglar-proof wireless light adjusting module is provided wherein a transmission socket of a control module is connected with a lamp and a local power, respectively, whereas a control socket at the other end is connected with a conventional switch. When the switch is turned on or off, a micro processor transmits a signal of lightening status of a corresponding light bulb to a driving circuit, generates a corresponding control circuit through the driving circuit, to enable the light bulb to generate a continuously changing status of lightening and extinguishing, a status of lightening and extinguishing according to a random time, and a constant brightness, after receiving a status of open circuit and short-circuit, corresponding to various times of status of turning on and off, from the control socket.

11 Claims, 12 Drawing Sheets

BURGLAR-PROOF WIRELESS LIGHT ADJUSTING MODULE

BACKGROUND OF THE INVENTION a) Field of the Invention

The present invention relates to a burglar-proof wireless light adjusting module, and more particularly to a burglar-proof wireless light adjusting module when applied in a normal way, a light bulb is kept at a prior brightness, i.e., a lightening status, and a switch is turned off and on one time quickly at the lightening status, so as to change the light bulb to a light adjusting status by a control module, gradually increasing the brightness of light bulb to a maximum, and then gradually decreasing until being extinguished, to form an action of continuously adjusting light repetitively; whereas the switch is turned off and on one time quickly at the light adjusting status, so as to keep the brightness of light bulb and stop the action of adjusting light.

When the module is used in a normal way, the control module records a last brightness of the light bulb, so as to keep the brightness at the adjusted brightness every time when the light bulb is turned on, thereby achieving functions of light adjusting and keeping brightness.

When the module is used in burglar-proof alert, the control module at the status of normal usage will change the light bulb into the status of burglar-proof alert after turning off and on a number of times with a switch, and control the status of lightening and status of extinguishing in a repetitive sequence with a random time.

The present invention is also equipped with a wireless remote control function, so as to perform all of the aforementioned operations with a remote controller.

b) Description of the Prior Art

As shown in FIG. 1 and FIG. 1*a,* a conventional stand lamp is connected with a controller B which is used to adjust a brightness of a light bulb C. In addition, some controllers B are equipped with a function of burglar-proof alertness which enlightens and extinguishes at a constant time period. However, it is easily to determine that there is actually no one in a house with a regular pattern of lightening and extinguishing.

Referring to FIG. 2 and FIG. 2*a,* for a conventional wall lamp A2, a lightening and extinguishing of a light bulb C is controlled through a switch E. However, a normal switch E simply provides a turning on/off control and does not have a function of adjusting light. The conventional switch E and a panel E1 should be removed and replaced with a switch with the function of light adjusting, if the switch capable of controlling light is to be used. However, for an existing multi-purpose switch, a design of its panel is plain, and cannot fit with a requirement of indoor design and decoration. Besides, its interior size is too big, causing difficulty in assembling and increasing troublesome to a user.

SUMMARY OF THE INVENTION

As shown in FIG. 3, FIG. 4, and FIG. 5, the present invention is to provide a burglar-proof wireless light adjusting module device, wherein a control module consists of an outer lid, a bottom lid, a connection wire, and a circuit board; the circuit board is emplaced between the outer lid and the bottom lid, and then sealed with a high cycle machine. A receiving port, a control socket, a transmission socket, a micro processor, a power circuit, a short-circuit protection circuit, a driving circuit, a radio receiver, and an encoding switch are emplaced on the circuit board.

A remote controller comprises an upper lid, a bottom lid, and a circuit board; the circuit board is installed between the upper lid and the bottom lid. A radio signal, an emitting port, a radio emitter, a micro processor, an encoding switch, a press-button switch, and a battery are emplaced on the circuit board.

Referring to FIG. 6 and FIG. 7, the transmission socket of the control module is connected with a lamp and a local power, respectively, whereas the control socket at the other end is connected with a conventional switch. When the switch is turned on or off, the micro processor transmits a signal of lightening status of the corresponding light bulb to the driving circuit, generates a corresponding control signal through the driving circuit, and generates a power for controlling lightening of the light bulb of the related lamp through the power circuit, after receiving status of an open circuit and short-circuit from the control socket corresponding to various numbers of turning on and off, so as to enable the light bulb to generate a continuously changing status of lightening and extinguishing, a status of lightening and extinguishing according to a random time, and a status of constant lightening brightness.

In addition to receiving a control signal of turning on and off from the switch, the control module also receives a control signal from the remote controller. When the press-button switch is turned on and off continuously or discontinuously, the micro processor receives a control signal of the press-button switch, then adds a signal identification code from the encoding switch into the control signal, then coverts the signal into a radio signal through the radio emitter, and then emits through the emitting port.

After receiving a radio signal by the receiving port of the control module, the radio receiver converts the radio signal into a control signal, and then transmits to the micro processor through the transmission socket. At this time, the micro processor compares the signal received with the identification code from the encoding switch, to assure that the control signal, which is corresponding to various numbers of status of turning on and off of the press-button switch, is from the remote controller, and then transmits the signal of lightening status of the corresponding light bulb to the driving circuit. A control signal is generated through the driving circuit, and a power for controlling the lightening of the related light bulb is generated through the power circuit, so as to enable the light bulb to generate a continuously changing status of lightening and extinguishing, a status of lightening and extinguishing according to a random time, and a status of constant lightening brightness.

To prevent from an occurrence of a short-circuit at the light bulb of the lamp, so that a high voltage of large current generated from burnout damages an internal circuit of the control module, the short-circuit protection circuit is installed inside the module, so as to prevent from the damage to the internal circuit by an abnormal voltage or current at a special condition.

The radio signal corresponding to the radio receiver and the radio emitter is further a transmission signal for a related radio signal transmission technology such as an infrared, a Blue-tooth, an FM (Frequency Modulation), or an AM (Amplitude Modulation).

The light bulb is further a tungsten light bulb, a high voltage halogen light bulb, or a related light bulb using a filament as a lightening source.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 11:
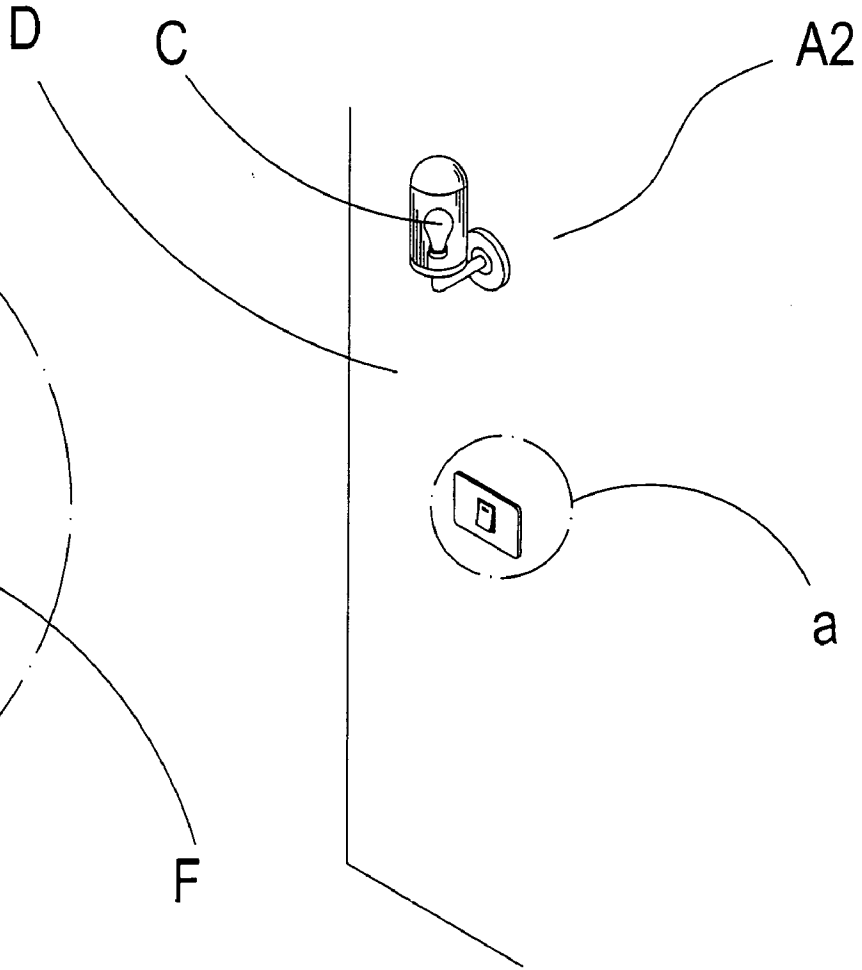
FIG. 11 shows another schematic view of an implementation of the present invention.
Figure 11A:
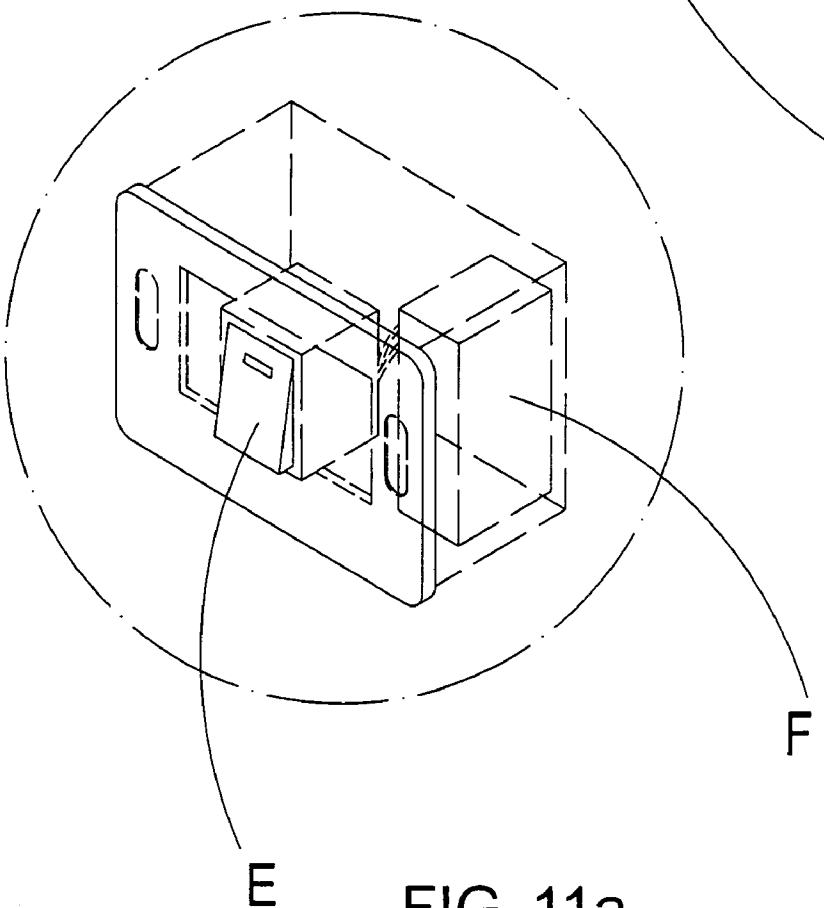
FIG. 11*a* shows an exploded view of part d of FIG. 11.
Figures 12, 12A:
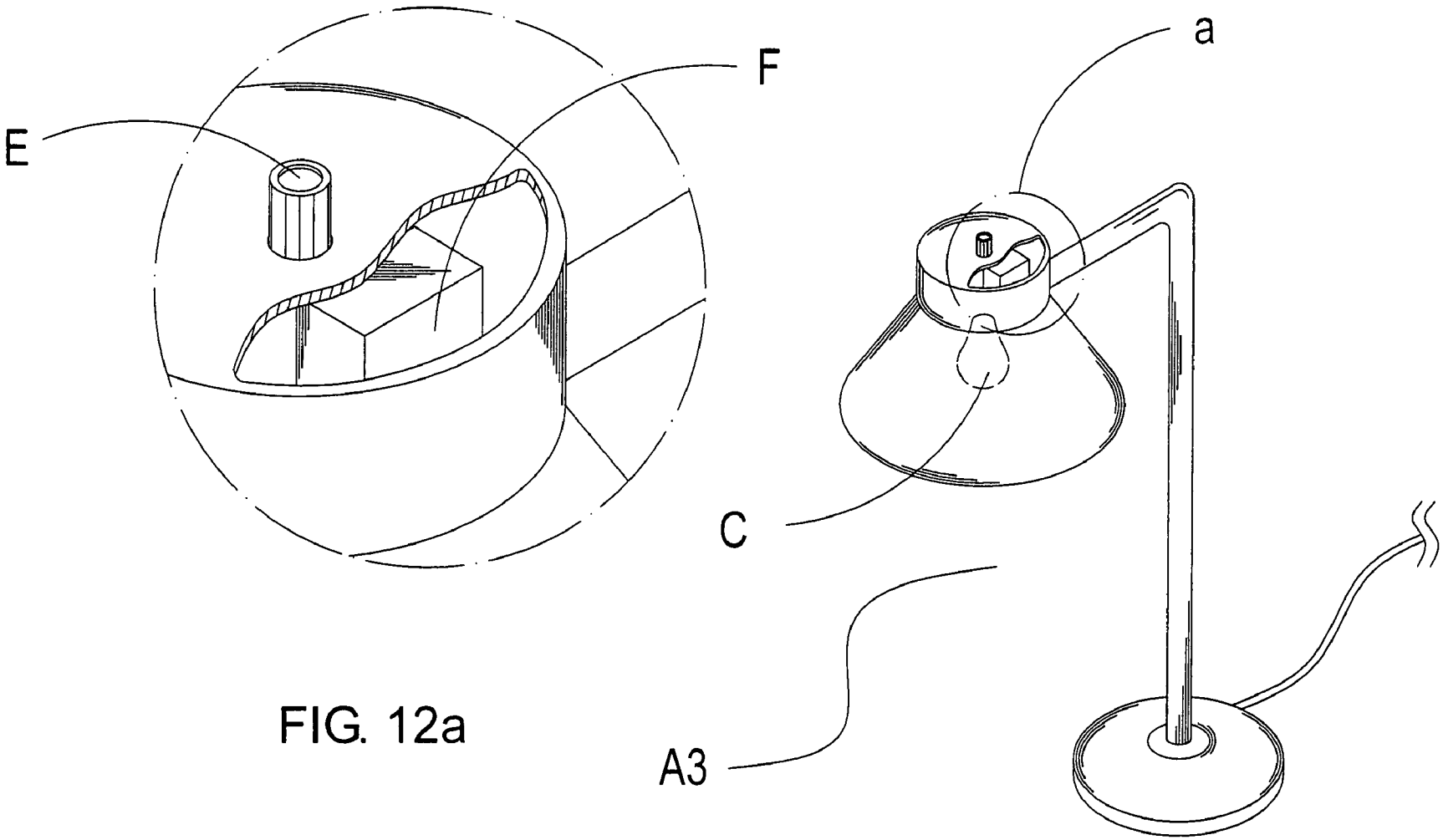
FIG. 12 shows still another schematic view of an implementation of the present invention.
FIG. 12*a* shows an exploded view of part e of FIG. 12.

Referring to FIG. 11 and FIG. 11*a*, a control module F is connected with a conventional switch E, and a wall lamp A2 is controlled through the control module F. As shown in FIG. 12 and FIG. 12*a*, a control module F is directly installed inside a desktop lamp A3, and the control module F is connected with a switch E of the desktop lamp A3. In addition, there is no need to replace the conventional switch E in the aforementioned connection methods.

Figure 1:
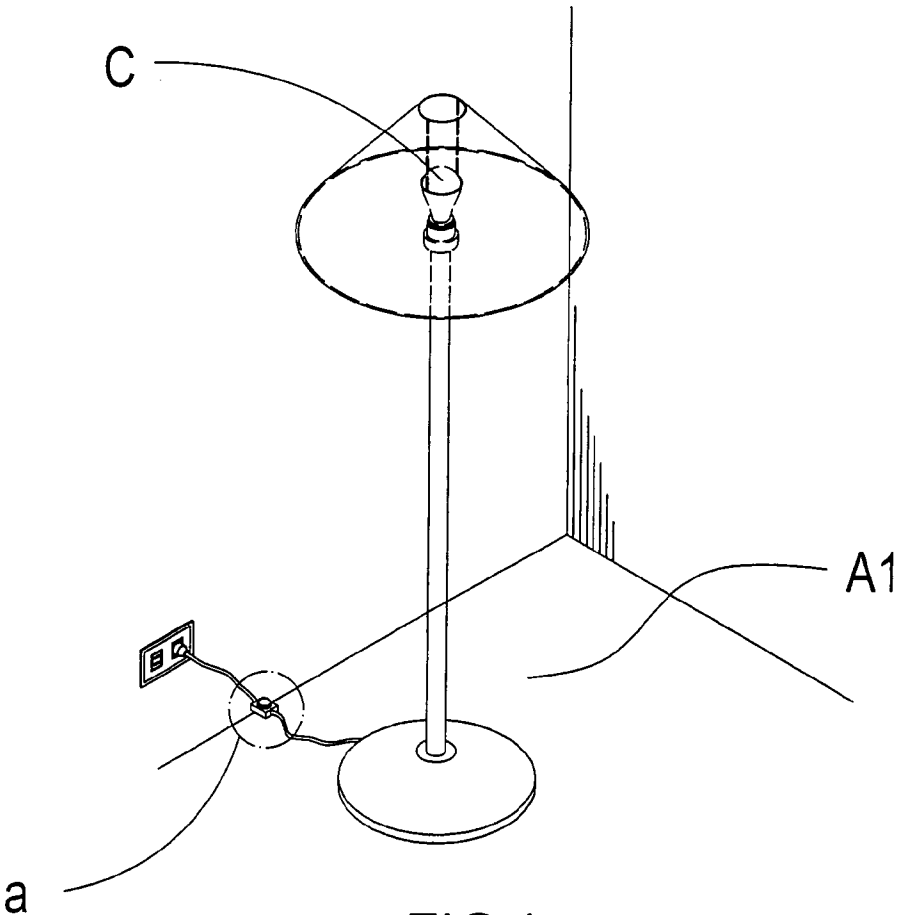
FIG.1 Prior Art
FIG. 1 shows a schematic view of a conventional stand lamp.
Figure 1A:
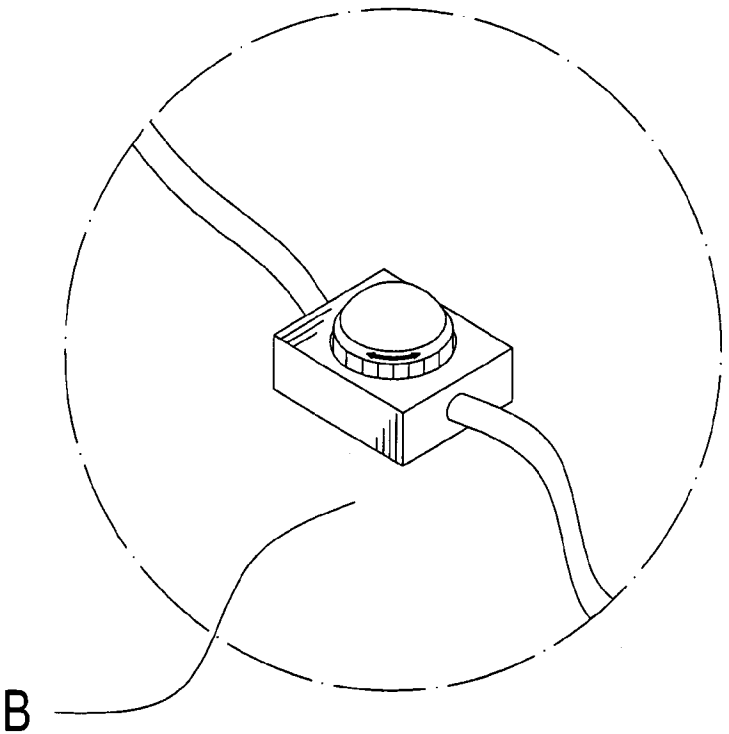
FIG. 1a Prior Art
FIG. 1*a* shows an exploded view of part a of FIG. 1.
Figure 2A:
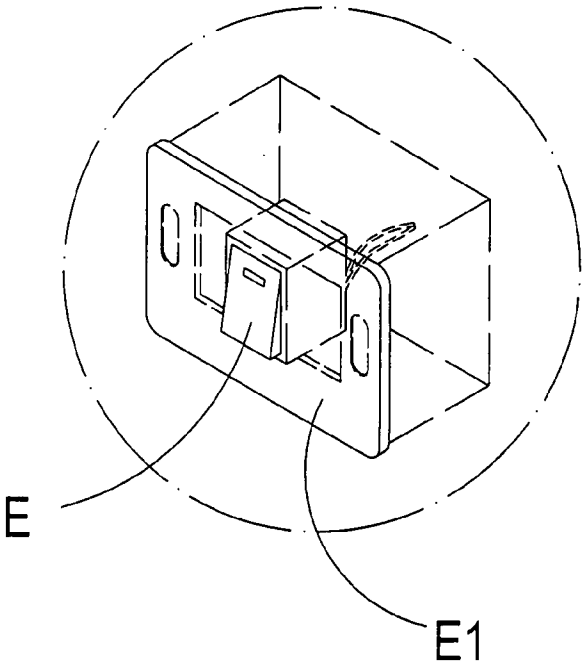
FIG. 2a Prior Art
FIG. 2*a* shows an exploded view of part b of FIG. 2.
Figure 2:
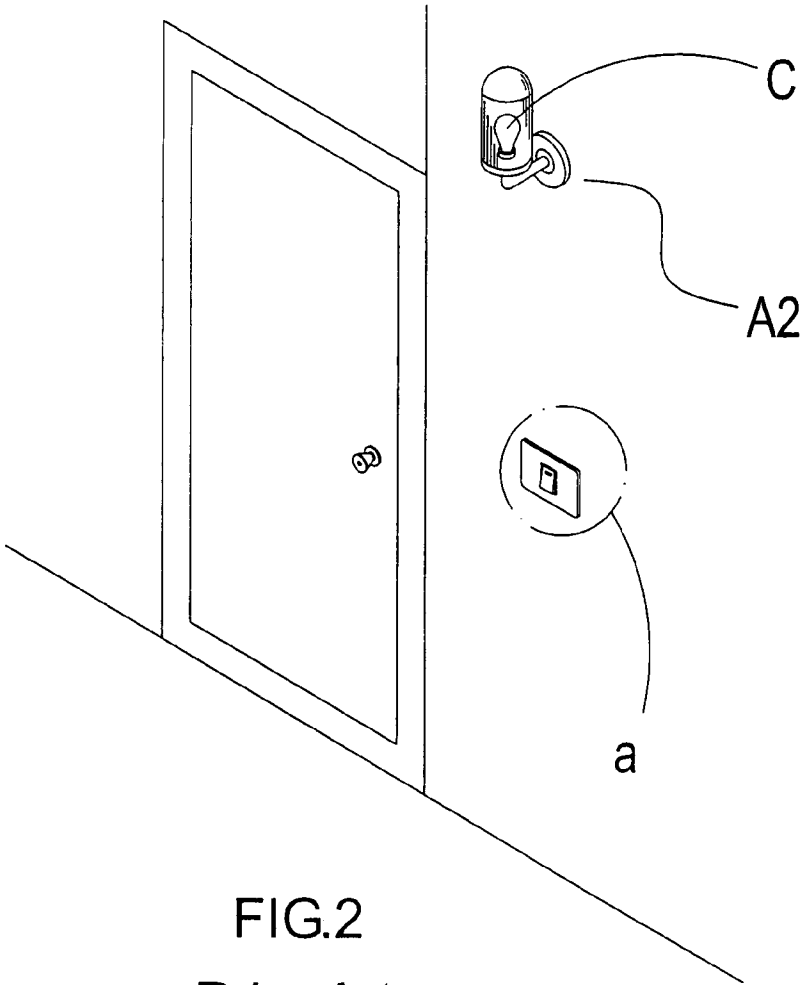
FIG.2 Prior Art
FIG. 2 shows a schematic view of a conventional wall lamp.
Figure 3:
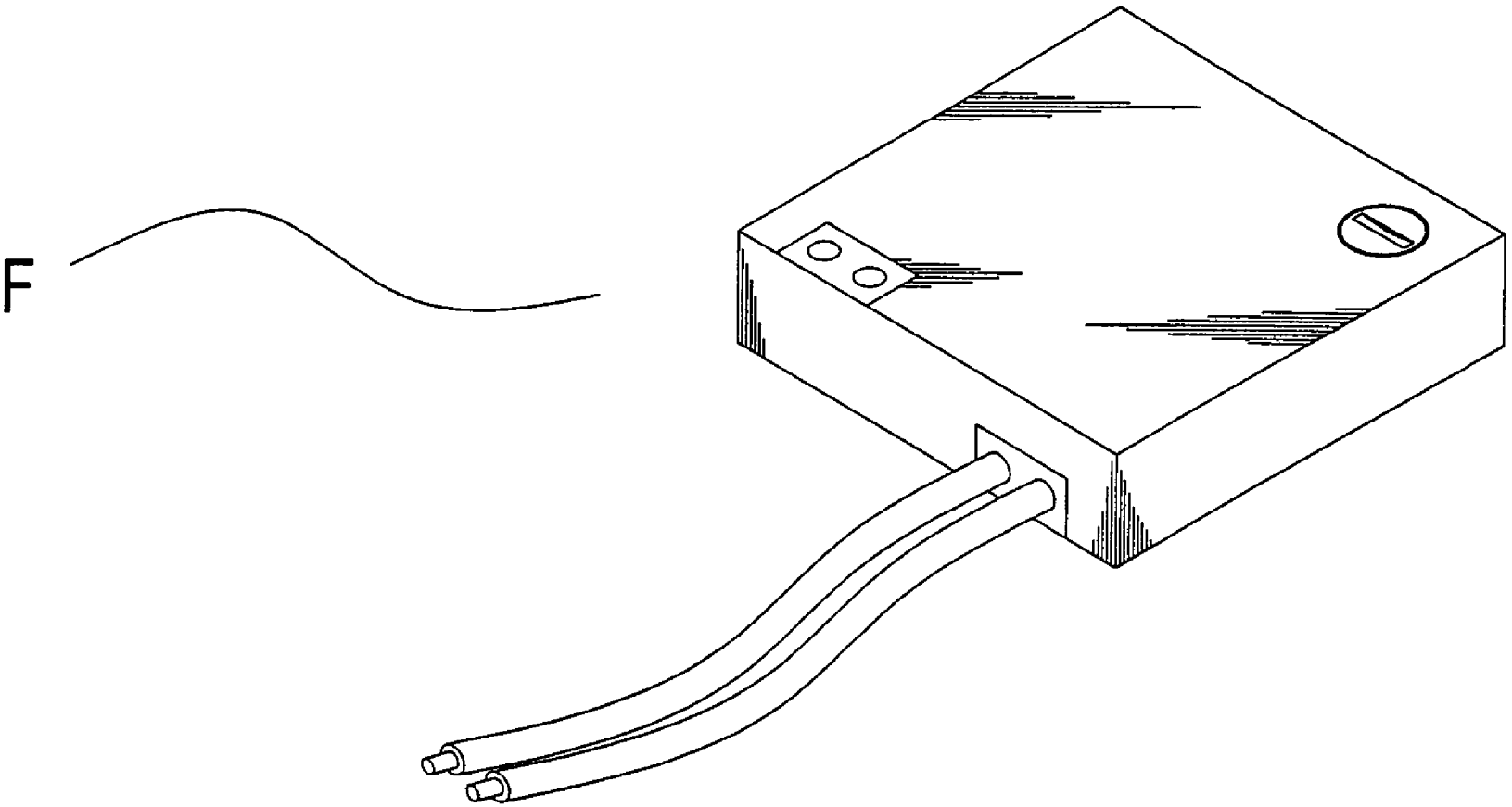
FIG. 3 shows a schematic view of the present invention.
Figure 4:
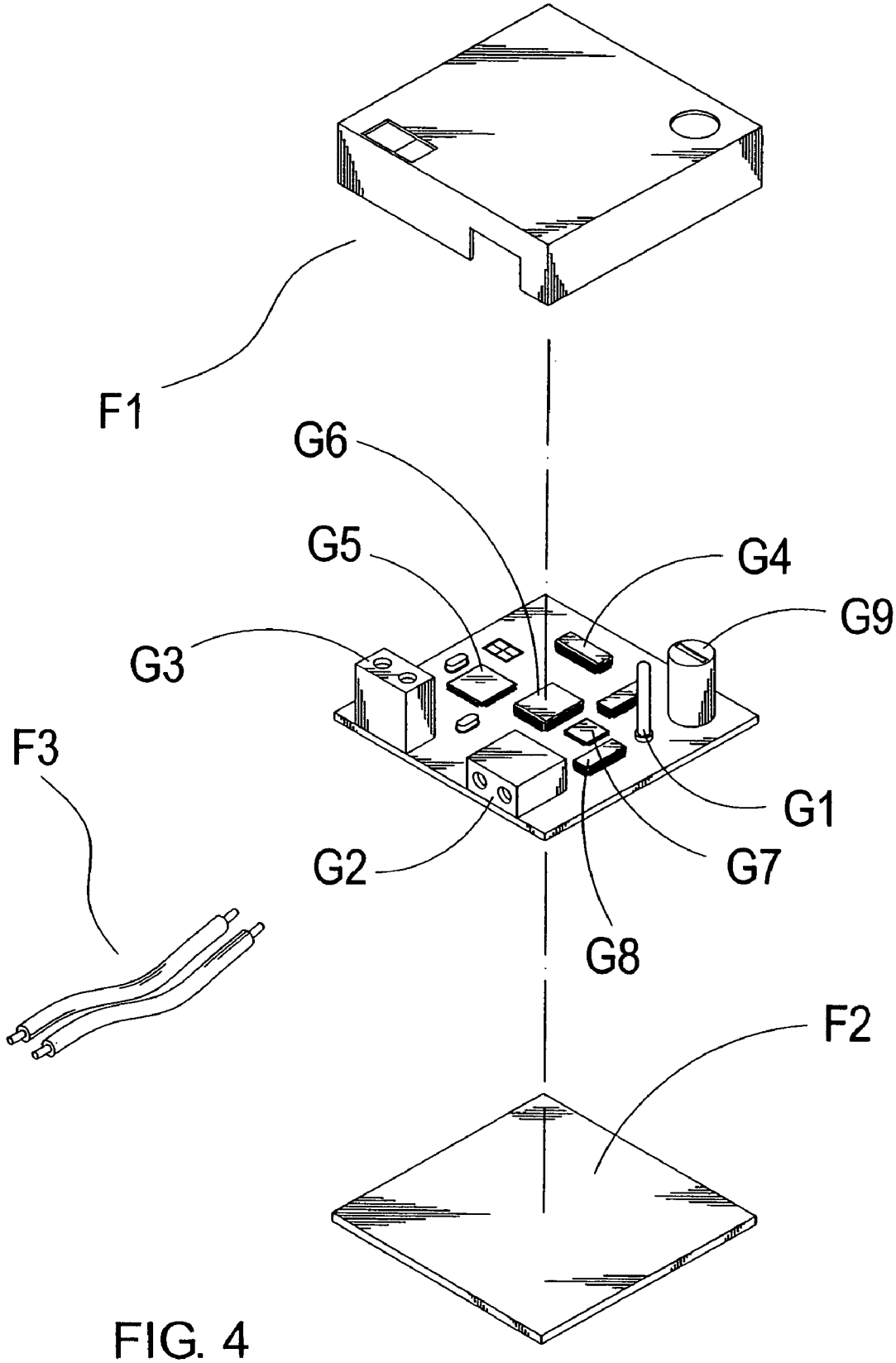
FIG. 4 shows an assembly view of the present invention.
Figure 5:
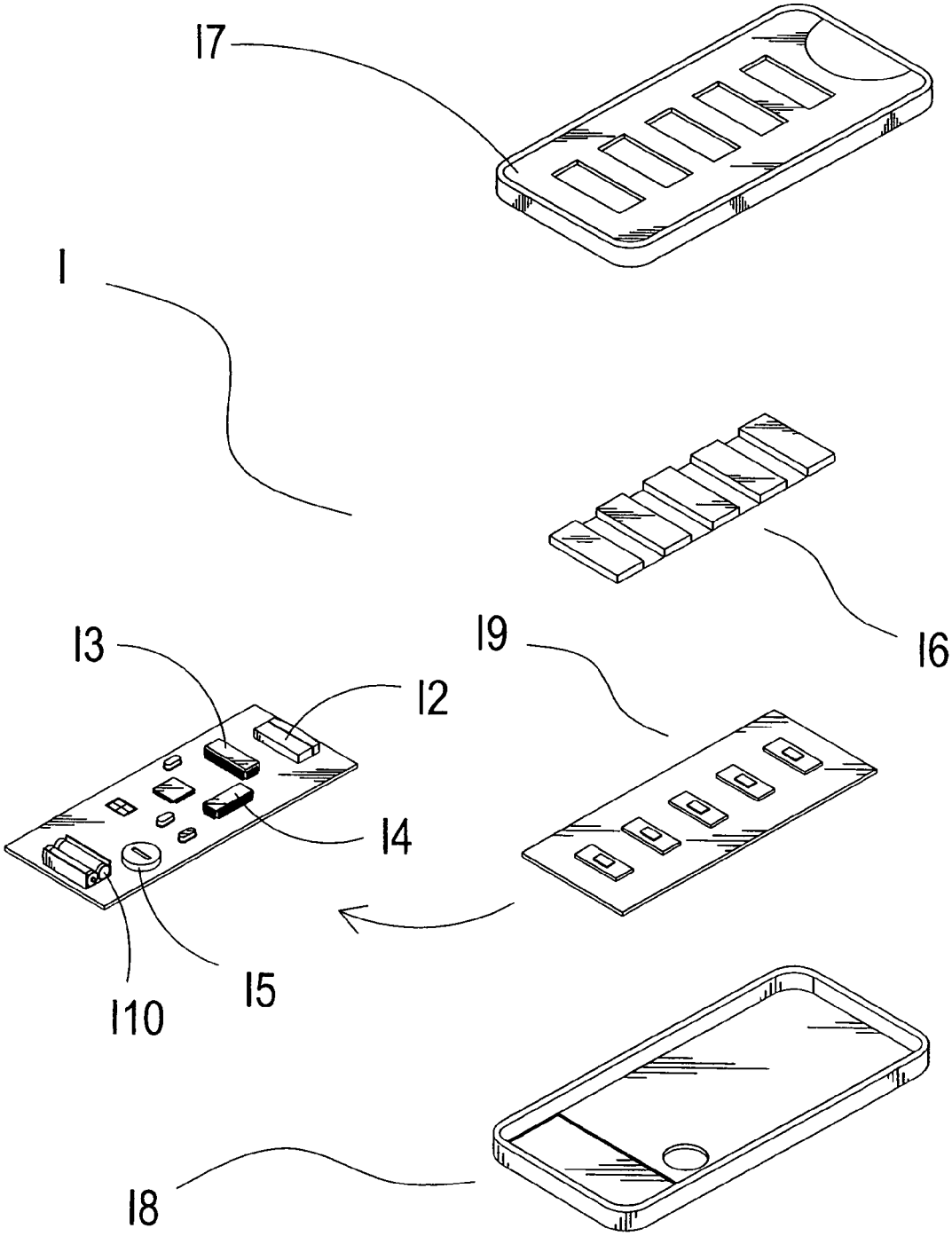
FIG. 5 shows an assembly view of a remote controller of the present invention.
Figure 6:
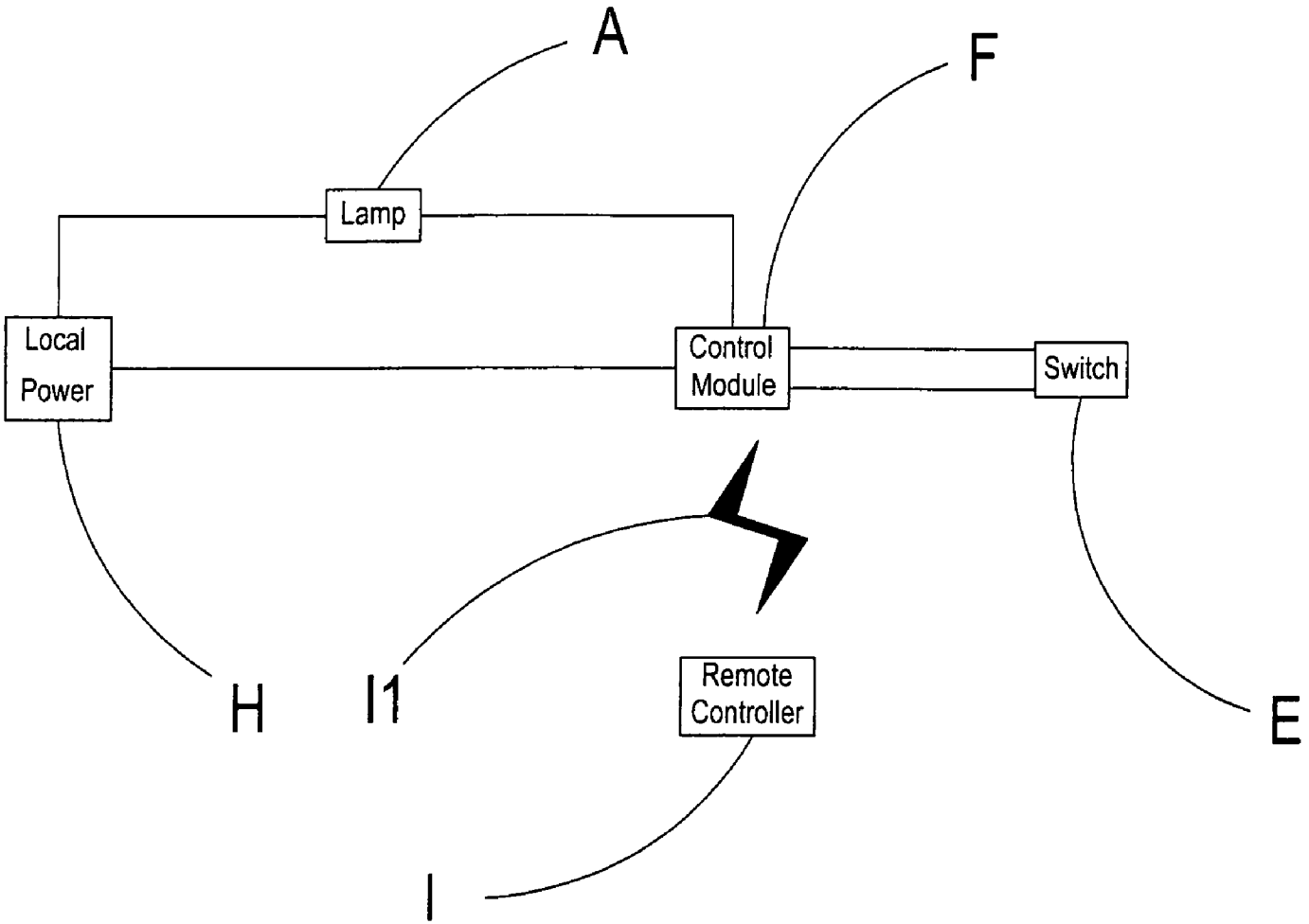
FIG. 6 shows a block diagram of a main process of the present invention.
Figure 7:
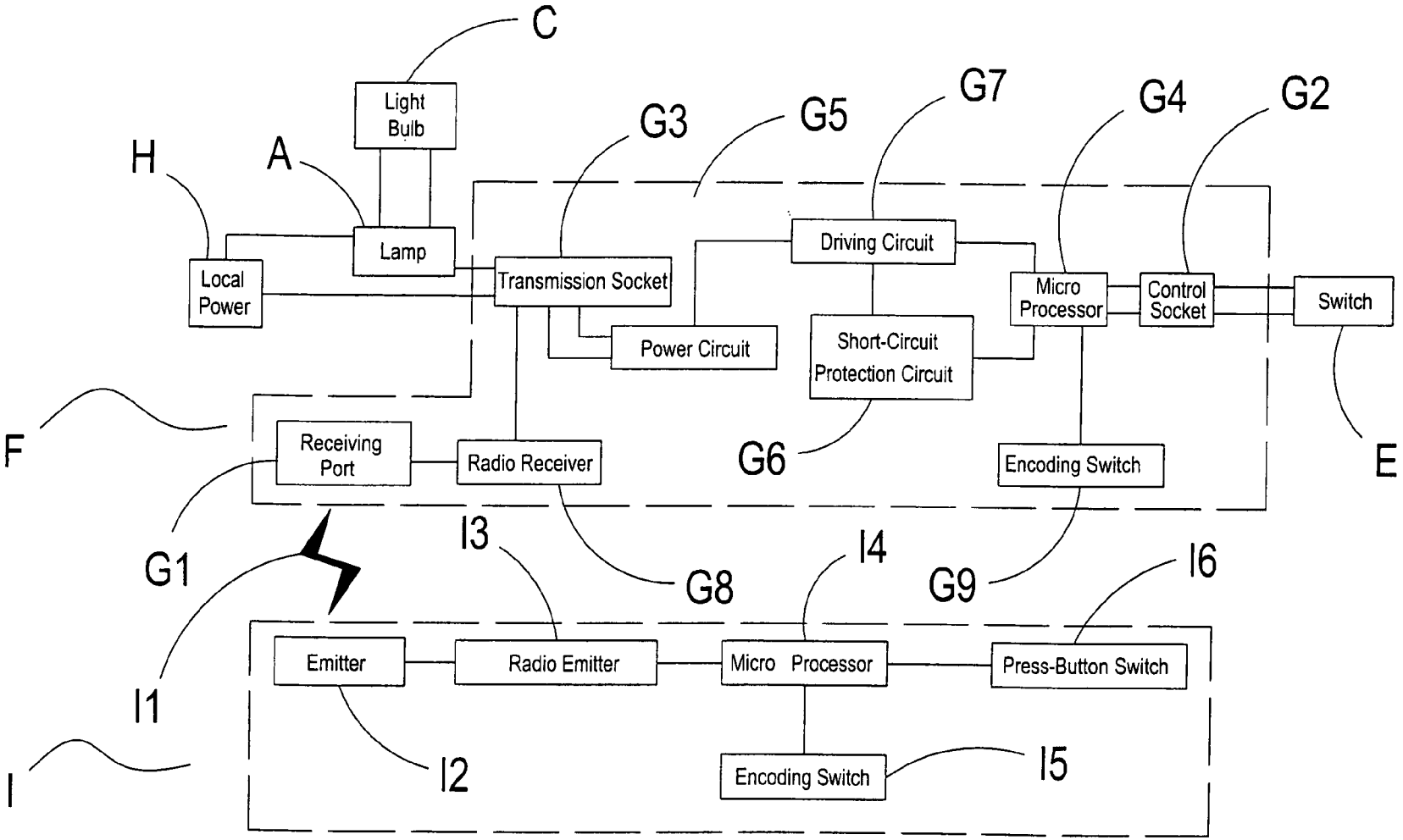
FIG. 7 shows a block diagram of circuit flow of the present invention.
Figure 8:
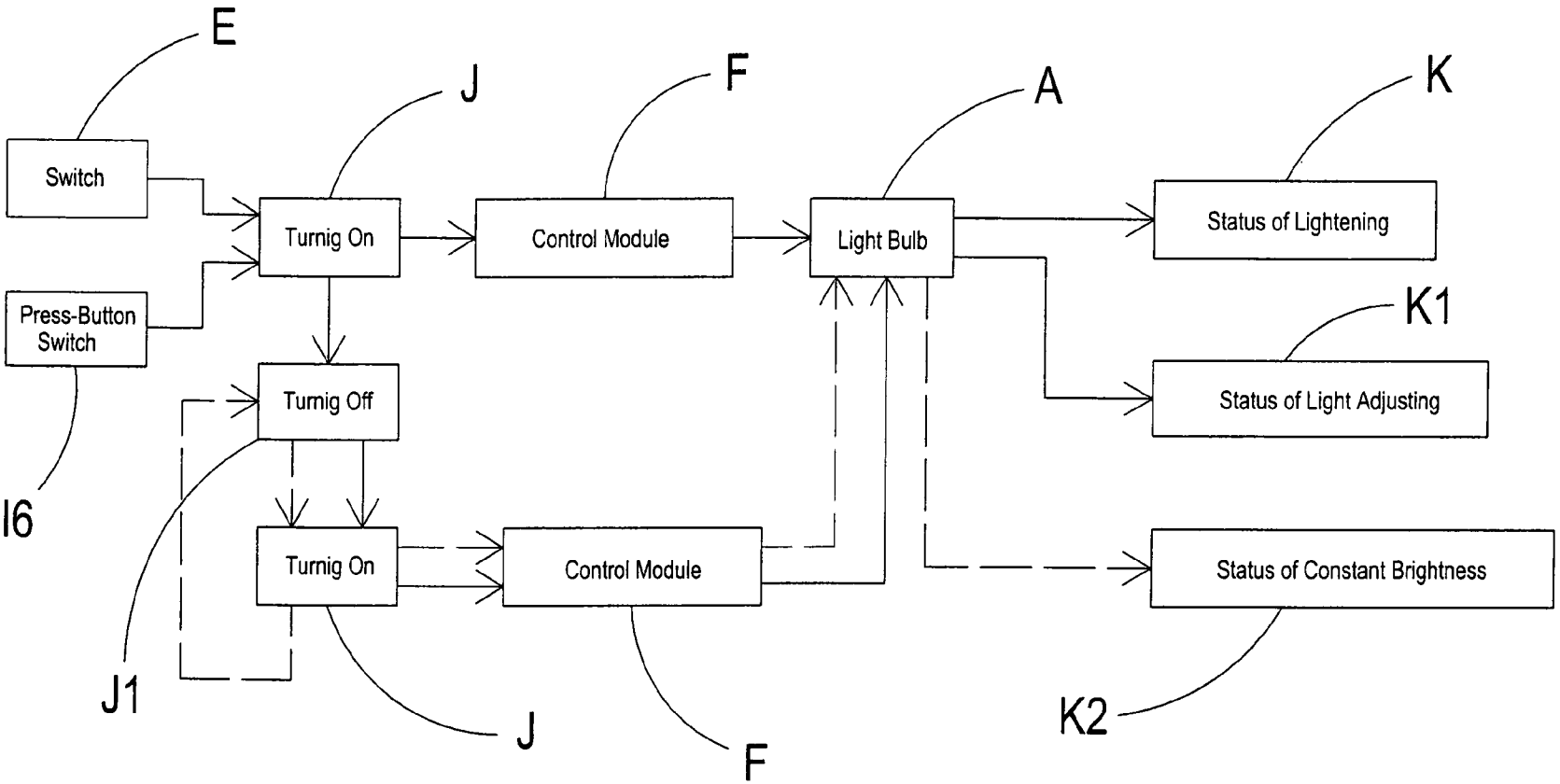
FIG. 8 shows a block diagram of an implementation of the present invention.

Referring to FIG. 8, after turning on the switch E in a normal usage, the light bulb is kept at a prior brightness, i.e. a lightening status K. After continuously turning on J and turning off J1 the switch E at the lightening status K, the control module F changes the light bulb C into a status of light adjusting K1 through an internal circuit (as shown in FIG. 6 and FIG. 7). At this time, the light bulb continuously enlightens and distinguishes in an analog way which gradually increases the brightness and gradually decreases the brightness until being extinguished.

After turning on J and turning off J1 the switch E at the status of light adjusting K1, the control module records the last brightness of the status of light adjusting K1, so as to keep the light bulb C at this brightness. In a normal usage, the control module F records the last brightness of the light bulb C, and keeps the brightness of the light bulb C within the adjusted brightness every time upon turning on J the switch E, thereby achieving the functions of adjusting light and keeping the brightness.

Figure 9:
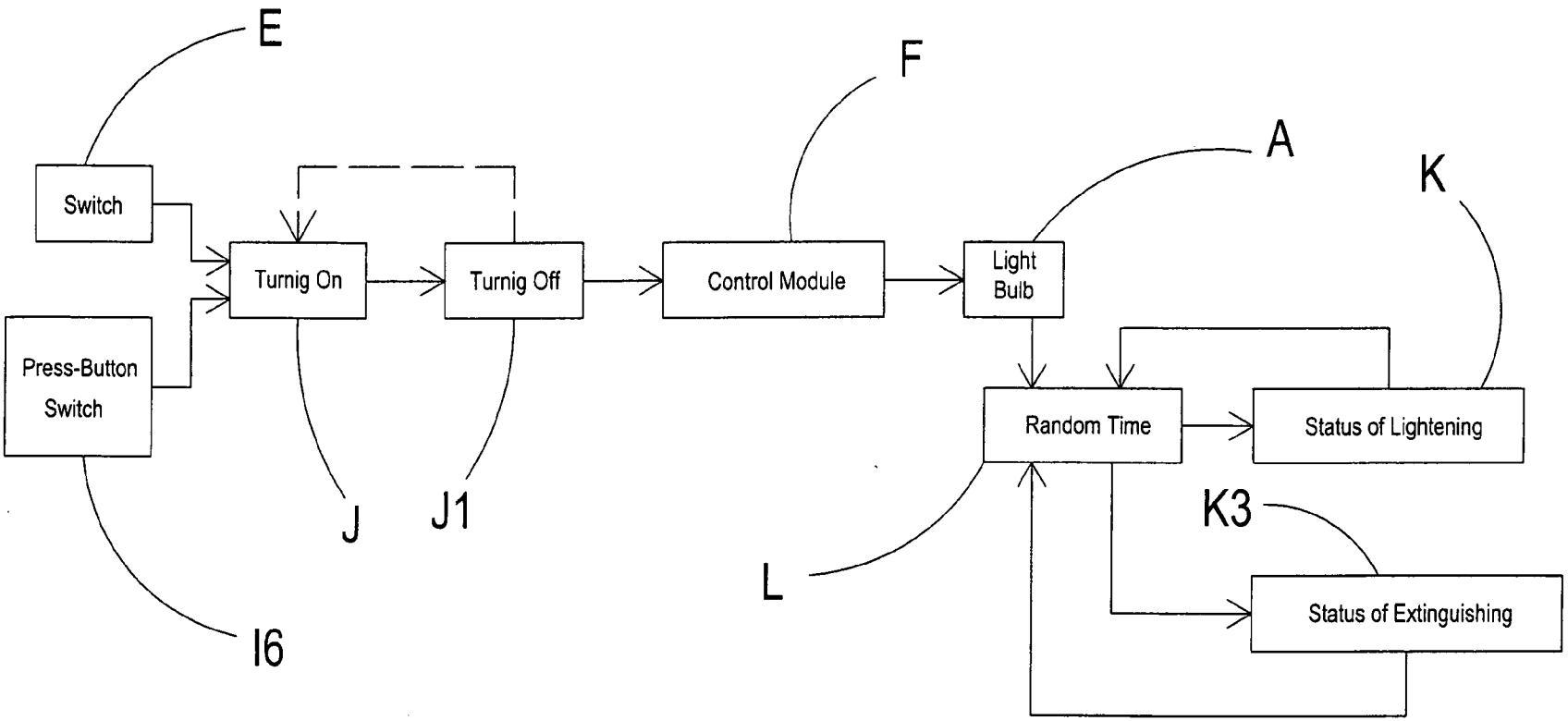
FIG. 9 shows a block diagram of another implementation of the present invention.

Referring to FIG. 9, upon used in burglar-proof alert, after continuously turning on J and turning off J1 the switch E a plurality of times, the internal circuit (as shown in FIG. 6 and FIG. 7) inside the control module F, which is at a status of normal usage, changes the light bulb C into a status of burglar-proof alert. After the light bulb C which is controlled with a random time L changes into the lightening status K and the random time L is expired, the light bulb C changes into an extinguishing status K3. This process continues in a repetitive cycle in that sequence, and the cycle of lightening status K and extinguishing status K3 of the light bulb C cannot be recorded, thereby achieving a function of active burglar-proof alert.

Figure 10:
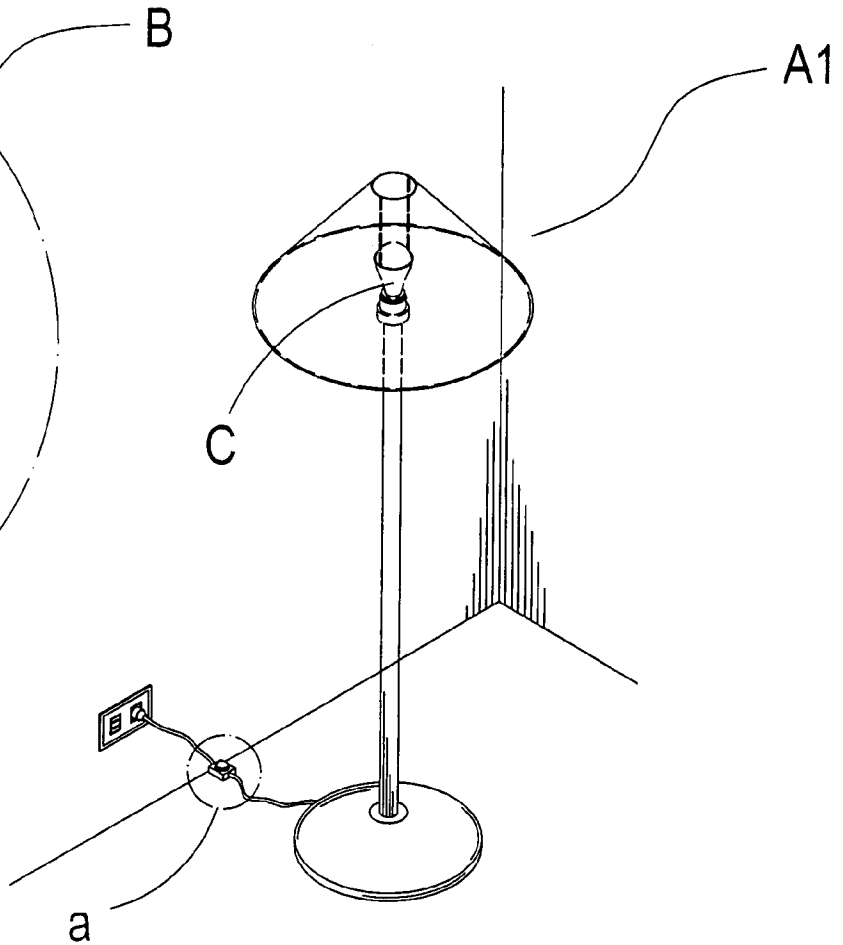
FIG. 10 shows a schematic view of an implementation of the present invention.
Figure 10A:
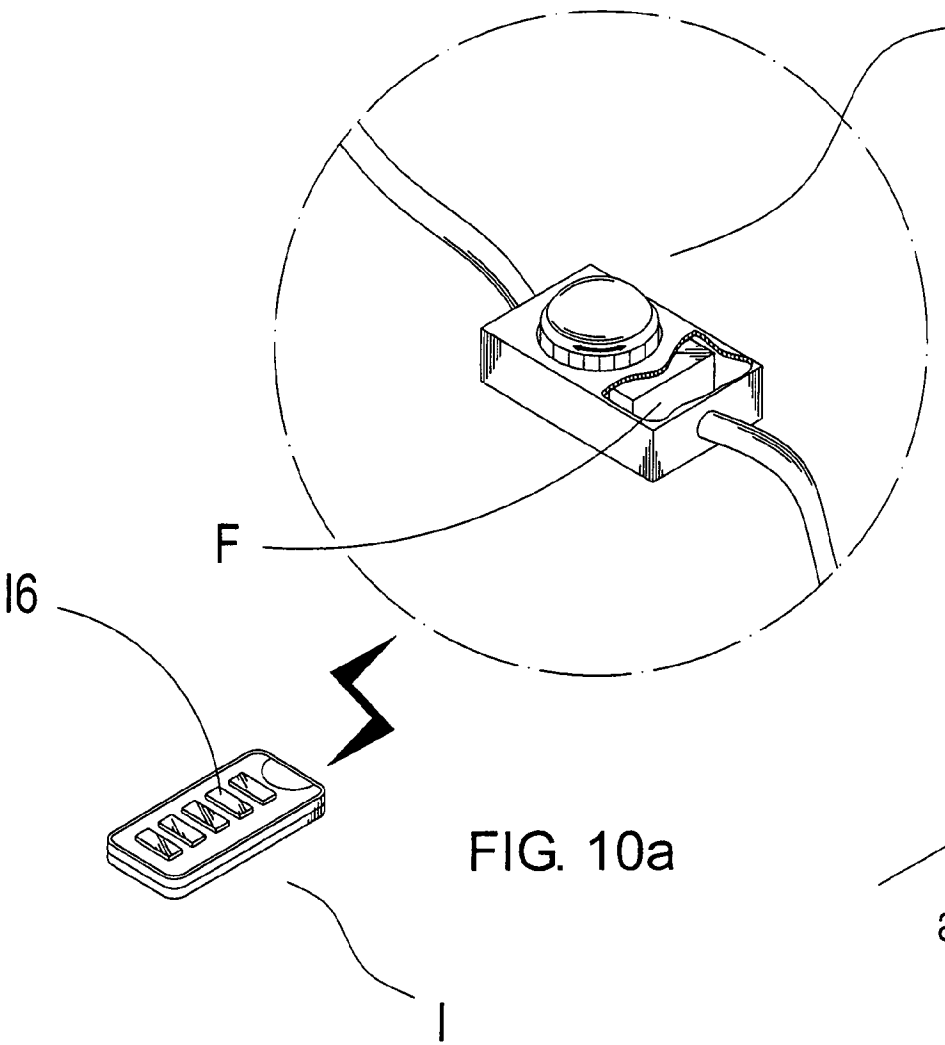
FIG. 10*a* shows an exploded view of part c of FIG. 10.

As shown in FIG. 10 and FIG. 10*a*, a control module F is installed inside a controller B of a stand lamp A, and a remote controller I is used to control a lightening and extinguishing of a light bulb C with a press-button switch I6. In a normal usage (as shown in FIG. 8), the press-button switch I6 is used to control the light bulb C to keep at a prior brightness, i.e., a lightening status K. After continuously turning on J and turning off J1 the press-button switch I6 at the lightening status K, the control module F changes the light bulb C into a status of light adjusting K1 through an internal circuit (as shown in FIG. 6 and FIG. 7). At this time, the light bulb C continuously enlightens and extinguishes in an analog way which gradually increases the brightness and gradually decreases the brightness until being extinguished.

After turning on J and turning off J1 the press-button switch I6 at the status of light adjusting K1, the control module F records a last brightness of the status of light adjusting K1 to keep the light bulb C at this brightness. In the mean time, in a normal usage, the control module F records a last brightness of the light bulb C to keep the brightness of the light bulb C within the adjusted brightness every time upon turning on J the press-button switch I6, thereby achieving the functions of adjusting light and keeping the brightness.

Referring to FIG. 9, upon used in burglar-proof alert, after continuously turning on J and turning off J1 the press-button switch 16 a plurality of times, the internal circuit (as shown in FIG. 6 and FIG. 7) inside the control module F, which is at a status of normal usage, changes the light bulb C into a status of burglar-proof alert. After the light bulb C which is controlled with a random time L changes into the lightening status K and the random time L is expired, the light bulb C changes into an extinguishing status K3. This process continues in a repetitive cycle in that sequence, and the cycle of lightening status K and extinguishing status K3 of the light bulb C cannot be recorded, thereby achieving a function of active burglar-proof alert. The present invention is compared with a conventional application as follow:

Shortcomings of a conventional application

- A wireless control is not available and a knob must be used for a light adjusting device.
- A burglar-proof alert has a limited effect, and must be operating at a constant period, which is easily to be guessed to identify that the function of burglar-proof is operating.
- A light adjusting device cannot be installed onto a conventional switch and the switch and a panel should be replaced.
- A switch with a light adjusting device cannot fit with an application in indoor design, and an appearance and design is monotonous.
- A cost of a switch with a light adjusting device is high, along with a large size and a heavy weight.
- A light adjusting device and an alert device must be installed separately, increasing the difficulty in installing.

Advantages of the present invention

- It is equipped with a wireless control function; a remote controller can be used to achieve the required functions.

It is small in size, light in weight, and is easy and quick to install.

It is compatible with specifications of a conventional switch and lamp.

There is no need to replace a conventional switch to perform functions of light adjusting and burglar-proof alert.

It uses a function of active burglar-proof alert such that it is not possible to guess that whether a lamp is controlled by a human or by a burglar-proof device.

It is convenient to operate without adding other equipment, and it is equipped with both functions of light adjusting and burglar-proof.

It has advancement, practicability and convenience.

It can promote an industrial upgrade, and can increase an industrial competitiveness.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A burglar-proof wireless light adjusting module comprising primarily an outer lid, a bottom lid, a connection wire and a circuit board which is emplaced between the outer lid and the bottom lid; a receiving port, a control socket, a transmission socket, a micro processor, a power circuit, a short-circuit protection circuit, a driving circuit, a radio receiver and an encoding switch emplaced on the circuit board; the transmission socket of the control module connected with a lamp and a local power, respectively, with the control socket at the other end connected with a switch; when turning on and off the switch a plurality of times, the micro processor transmitting a signal of lightening status of a corresponding light bulb to the driving circuit, generating a corresponding control signal through the driving circuit, and generating a power for controlling the lightening of the light bulb of the related lamp through the power circuit, after receiving a status of open circuit and short-circuit, corresponding to various times of status of turning on and turning off, from the control socket, wherein the burglar-proof wireless light adiusting module is further controlled by a remote controller comprising an upper lid, a bottom lid, and a circuit board emplaced between the upper and bottom lids; a radio signal, an emitting port, a radio emitter, a micro processor, an encoding switch, a press-button switch installed on the circuit board; when a plurality of times of turning on and off the press-button switch, the micro processor receiving a control signal from the press-button switch, adding a signal identification code from the encoding switch into the control signal, converting to the radio signal through the radio emitter, and emitting through the emitting port; the receiving port of the control module receiving the radio signal and converting to the control signal through the radio receiver; the micro processor comparing the identification code from the encoding switch with the signal received to determine that the signal is from the remote controller, and control the light bulb of the lamp.

2. The burglar-proof wireless light adjusting module according to claim 1, wherein the radio signal corresponding to the radio receiver and the radio emitter is further a transmission signal for related radio signal transmission technology such as an infrared, a Blue-tooth, an FM (Frequency Modulation), or an AM (Amplitude Modulation).

3. The burglar-proof wireless light adjusting module according to claim 1, wherein the radio signal corresponding to the radio receiver and the radio emitter is further a transmission signal for related radio signal transmission technology such as an infrared, a Blue-tooth, an FM (Frequency Modulation), or an AM (Amplitude Modulation).

4. The burglar-proof wireless light adjusting module according to claim 1, wherein the light bulb generates a continuously changing status of lightening and extinguishing, a status of lightening and extinguishing according to a random time, and a constant brightness, corresponding to the control module.

5. The burglar-proof wireless light adjusting module according to claim 4, wherein the light bulb is further a tungsten light bulb, a halogen light bulb, and a related light bulb using a filament as a source of lightening.

6. The burglar-proof wireless light adjusting module according to claim 1, wherein the lamp is further a stand lamp, a desktop lamp, a wall lamp, and a related lightening device using a filament.

7. The burglar-proof wireless light adjusting module according to claim 1, wherein the lamp is further a stand lamp, a desktop lamp, a wall lamp, and a related lightening device using a filament.

8. The burglar-proof wireless light adjusting module according to claim 1, wherein the light bulb is further a tungsten light bulb, a halogen light bulb, and a related light bulb using a filament as a source of lightening.

9. The burglar-proof wireless light adjusting module according to claim 1, wherein the light bulb is further a tungsten light bulb, a halogen light bulb, and a related light bulb using a filament as a source of lightening.

10. A burglar-proof wireless light adjusting module comprising primarily an outer lid, a bottom lid, a connection wire and a circuit board which is emplaced between the outer lid and the bottom lid; a receiving port, a control socket, a transmission socket, a micro processor, a power circuit, a short-circuit protection circuit, a driving circuit, a radio receiver and an encoding switch emplaced on the circuit board; the transmission socket of the control module connected with a lamp and a local power, respectively, with the control socket at the other end connected with a switch; when turning on and off the switch a plurality of times, the micro processor transmitting a signal of lightening status of a corresponding light bulb to the driving circuit, generating a corresponding control signal through the driving circuit, and generating a power for controlling the lightening of the light bulb of the related lamp through the power circuit, after receiving a status of open circuit and short-circuit, corresponding to various times of status of turning on and turning off, from the control socket, wherein the light bulb generates a continuously changing status of lightening and extinguishing, a status of lightening and extinguishing according to a random time, and a constant brightness, corresponding to the control module.

11. The burglar-proof wireless light adjusting module according to claim 10, wherein the light bulb is further a tungsten light bulb, a halogen light bulb, and a related light bulb using a filament as a source of lightening.

* * * * *